United States Patent [19]

Downing

[11] Patent Number: 4,867,225

[45] Date of Patent: Sep. 19, 1989

[54] COATED EXPENDABLE CORES FOR DIE CASTING DIES

[75] Inventor: Robert E. Downing, Toledo, Ohio

[73] Assignee: Farley, Inc., Chicago, Ill.

[21] Appl. No.: 319,543

[22] Filed: Mar. 6, 1989

Related U.S. Application Data

[63] Continuation-in-part of Ser. No. 173,558, Mar. 23, 1988, abandoned.

[51] Int. Cl.[4] ..... B22C 3/00; B22C 1/22; B22C 9/10

[52] U.S. Cl. ..... 164/369; 164/72; 164/113; 164/138; 164/527; 427/134; 523/139; 523/148

[58] Field of Search ..... 164/369, 72, 113, 138, 164/527; 427/134; 523/139, 148

[56] References Cited

U.S. PATENT DOCUMENTS

| | | | |
|---|---|---|---|
| 3,922,245 | 11/1975 | Skubon et al. | 427/134 X |
| 4,001,468 | 1/1977 | Skubon et al. | 427/134 |
| 4,096,293 | 6/1978 | Skubon et al. | 427/134 |
| 4,194,915 | 3/1980 | Perkins | 427/134 X |
| 4,413,666 | 11/1983 | Page | 164/72 |
| 4,529,028 | 7/1985 | Dybala et al. | 164/138 X |
| 4,766,943 | 8/1988 | Page | 164/72 X |

*Primary Examiner*—Nicholas P. Godici
*Assistant Examiner*—J. Reed Batten, Jr.
*Attorney, Agent, or Firm*—Hugh Adam Kirk

[57] ABSTRACT

The coatings are for an expendable sand core for die casting dies, which sand core has spaces between its contacting sand grains at least partially filled with resin binder. The first, base, hard, or refractory coating for this core is applied from an aqueous suspension comprising a finely ground refractory of fused silica, a refractory binder, and at least two different compounds selected from the groups of compounds or additives consisting of: (1) a suspension agent, (2) a dispersant, (3) a wetting agent, and (4) an anti-skinning agent. The refractory in the first coating may also include a minor amount, i.e. less than 50%, of another refractory oxide. The amount of binder in the first coating is less than about 15% by weight of the total liquid suspension, and the amount of additives is less than about 1.5% and usually less than 1% by weight of the total liquid suspension. The second, top, soft, or release coating is an organic liquid suspension containing between about 5% and 60% by weight of the whole suspension of particles of a release material selected from the group consisting of anhydrous powdered aluminum, graphite, talc, titanium dioxide, and zircon, and less than about 10% by weight of the total suspension of a resinous binder, less than 15% of at least two additives or different compounds selected from the groups additives and compounds consisting of a suspension agent, a dispersant, and an anti-setting agent.

55 Claims, No Drawings

COATED EXPENDABLE CORES FOR DIE CASTING DIES

RELATED PATENT AND PATENT APPLICATION

This application is a continuation-in-part of application Ser. No. 07/173,558 filed March 23, 1988 and now abandoned. This application is also an improvement in the die casting sand cores and core coatings disclosed in applicant's assignee's copending patent application Ser. No. 496,978 filed Oct. 3, 1983 to Enno H. Page, now U.S. Patent No. 4,766,943 issued Aug. 30, 1988, and applicant's assignee's U.S. Pat. No. 4,413,666 issued Nov. 8, 1983 to Enno H. Page and No. 4,529,028 issued July 16, 1985 to Dybala and Maczko.

BACKGROUND OF THE INVENTION

There are many patents on expendable cores for casting dies with various compositions of coatings for the dies and the cores therefor to withstand the hot metals poured or injected into the dies until the metals are solidified. Even applicant's assignee owns the above mentioned related patents and patent application which disclose expendable sand cores having coatings, which cores have good shake-out properties, good wash-out resistance, good resistance to surface penetration, good shelf-life, and high core strength to withstand pressures in excess of 1000 psi to form smooth undercut regions in die castings.

Nevertheless, still higher pressures in die casting processes are often desired and therefore it is essential to increase the strength of the expendable cores used therein. Applicant, after considerable experimenting and testing, has unexpectedly discovered new compositions and additives for the coatings of such expendable sand cores for die casting dies, which coated cores have improved physical properties over what has been known before; namely to withstand greater pressures and hotter metal melts, and to produce smoother undercut portions in die castings.

OBJECTS AND ADVANTAGES

Accordingly, it is an object of this invention to improve expendable coated sand cores for die casting dies, which cores are stronger than the coated expendable cores disclosed in the known prior art.

Another object is to produce coatings for expendable sand cores for die casting dies, which cores will withstand pressures up to about 14,000 pounds per square inch.

Another object is to produce coatings for expendable sand cores for die casting dies which adhere better and penetrate further into the sand grains on the surface of the cores to produce a stronger shell and a harder surface on the cores than previously known coatings.

Another object is to produce a coating for expendable sand cores for die casting dies which coating resists cracking and resists penetration and thermal deterioration by the hot metal injected into the dies.

Still another object is to produce an expendable die casting core which forms in die castings undercut regions with smoother undercut surfaces than previously known.

A further object is to improve the quality of the liquid suspensions of coatings for expendable sand cores, which liquid suspensions have a greater stability, a better shop life, and do not evaporate like the prior known coatings as disclosed in applicant's assignee's above mentioned patents and application.

Still a further object is to produce coated expendable sand cores which separate more easily from the final die cast casting than has been obtained with the coatings disclosed in applicant's assignee's above mentioned patents and patent application.

Another object is to produce die casting dies having such expendable core and die castings made therefrom which may include smooth undercut regions.

SUMMARY OF THE INVENTION

The products produced by this invention generally comprise an expendable sand core with two improved coatings, a first, base, hard refractory coating and a second, top, soft release coating. This coating core is then placed into a die casting die. Next, molten metal is injected under high pressure into the die to produce a casting with an undercut region formed by the coated core. When the metal has solidified and the resulting casting, usually of aluminum and its related metals and alloys, is removed from the die casting die, the core is then easily removed from the casting forming a smooth undercut region therein.

The expendable core is preferably formed of silica sand placed in a mold so that each sand grain is in contact with an adjacent sand grain, and the sand grains are bound together by a resin oxidized in the mold.

This sand core is then dipped or sprayed with an aqueous suspension comprising the first, base, hard refractory coating for the core, which aqueous suspension contains finely ground fused silica as its primary and major refractory material, but which may also contain a minor amount of other refractory oxides. These refractory materials have particle sizes less than about 100 microns and an average particle size of less than about 50 microns so as to be easily suspended in an aqueous solution. This first coating aqueous suspension also includes less than about 15% by weight of a binder for these particles which is a refractory material and comprises colloidal silica. Particles of the refractory and binder are maintained in this aqueous suspension by the addition of less than 1.5% and usually less than about 1% by weight of the aqueous suspension of two different compounds or additives selected from the groups of additives consisting of (1) a suspension agent, (2) a dispersant, (3) a wetting agent, and (4) an antiskinning agent. These four additives may act, respectively, also as a thickening agent, a deflocculent, to reduce surface tension, and to reduce water evaporation. These agents not only improve the shelf life of the aqueous suspension, but also unexpectedly improve the quality of the coating, and as a result thereof, an improved surface on the undercut region in the final die cast product. In this composition the amount of water in this first coating aqueous suspension is critical for the proper effect of the additives, that is the water content is at least 12% and not more than 30% by weight of the whole mixture suspension.

After the first, base, or refractory coating is dried on the sand core, the second, top soft release coating is applied by either dipping or spraying, which second coating liquid suspension comprises primarily solid particles of a release material selected from a group consisting of powdered aluminum, graphite, talc, titanium dioxide, and zircon, suspended in a non-aqueous solvent, such as for example isopropyl alcohol. The particle size of the release material solids are less than about 100 microns and preferably having an average particle size of less than about 40 microns. This solvent or liquid comprises at least 30% and up to 90% by weight of this second coating liquid suspension. In order to insure a uniform suspension of the particles of release material in this organic solvent, there is added less than about 10% by weight of a resinous binder, preferably a thermoplastic resin, and less than about 15% of at least two different compounds or additives selected from the groups of additives consisting of: (1) a suspension agent of an aluminum silicate compound (similar to the suspension agent employed in the first coating aqueous suspension, (2) a dispersant, and (3) an anti-settling agent.

When this second or release coating has dried, the coated core is then ready for placement into the die casting die for production of a casting with an undercut region formed by this coated core.

DETAILED DESCRIPTION OF PREFERRED EMBODIMENTS

I. Sand Base Core

The composition of the sand base core may be a white silica washed spherical grain sand having a low acid value and a neutral pH, that is between 6 and 8. These sand particles are blown into a mold and bound together by a binder which comprises between about 0.7 and 5% by weight of the sand. If this binder is a furan resin it may range between about 0.75 and 2.5% by weight of the sand, and preferably between about 1 and 2%, and more preferably between about 1.3 and 1.7% by weight of the sand. This furan resin is cured in situ in the mold with sulfur dioxide gas. The binder also may contain between about 2 and 20% by weight of the binder of silane, preferably between about 3.5 and 15% and more preferably between about 5 and 10% by weight of the furan resin. This furan resin also contains methyl ethyl ketone peroxide in an amount between about 40 and 70% by weight of the binder, and preferably between about 50 and 60%, and more preferably about 55% by weight of the binder. Thus, this base sand core is similar in composition to that disclosed in the above mentioned related patents and patent application assigned to applicant's assignee.

II. The First, Base Hard Refractory Coating

The composition of the aqueous suspension which forms the first, base hard refractory coating on the sand core comprises primarily fused silica ground so that all the particle sizes are less than 100 microns, with an average particle size of less than about 50 microns. This refractory comprises between about 40 and 85% and preferably between about 65 and 85% by weight of the aqueous coating, and of this refractory the fused silica ranges between about 40 and 80% by weight of the aqueous suspension. In the grinding of this fused silica there is obtained less than about 15% of colloidal silica and usually less than about 10%, that is of less than about 1 micron in size, which colloidal silica acts as a binder for the particles in the final coating and more colloidal silica may be added, if desired. However, a minor percentage of the solids in the final coating may comprise similar micron sized particles of other refractory oxides, such as alumina, zirconia and kaolin, which may range from 0% up to less than about 50% by weight of the aqueous suspension, and correspondingly a minor percentage of these other refractory particles in the coating. However, coatings without any other refractory oxides than fused silica therein have been found to be very satisfactory.

To this aqueous suspension of refractory and binder particles there are added less than about 1.5% by weight of aqueous suspension of at least two different compounds or additives from the following four groups of additives or agents, namely:

(1) The first additive, namely a suspension agent, in this instance acts more as a thickener or thickening agent and comprises a clay derivative or aluminum silicate compound, such as for example "Bentone" which is an aminated bentonite, semectite, or hectorite. The percentages of this suspension agent ranges up to about 1% by weight of the aqueous suspension. (2) The dispersant which acts as a deflocculent or a dispersing agent is added in an amount less than about 1.5% and preferably less than about 0.8% by weight of the aqueous suspension. This agent may comprise an alkali phosphate and/or poly acrylate, including a poly methacrylate, which promotes and maintains the separation of the individually extremely fine particles of solids of refractory in the suspension and prevents their flocculation.

(3) The wetting surfactant agent improves the dispersing of the particles in the liquid by reducing the surface tension when dissolved in water, such as causing the water to penetrate more easily into or to be spread over the surface of the particles in the suspension. An effective wetting agent includes compounds having acid and hydroxyl radicals such as a tertiary acetylene diol. The percentage of the wetting agent is less than about 0.5% and preferably less than 0.1% by weight of the aqueous suspension.

(4) The anti-skinning agent prevents evaporation of water from the composition and may comprise a higher aliphatic alcohol of 8 or more carbon atoms. The percentage of anti-skinning agent is less than about 0.1% by weight of the aqueous suspension.

After the core has been coated with this aqueous suspension of the first coating and dried, this hard coating has a thickness of between about 25 and 2000 microns, and preferably between about 100 and 750 microns (0.004 and 0.030 inches) and more preferably between about 150 and 500 microns (micrometers) (0.006 and 0.020 inches).

III. The Second, Top, Soft Release Coating

The core with its dried first coating is then coated with the liquid suspension of the second soft coating which comprises primarily solid particles of one or more release materials selected from the group consisting of anhydrous aluminum powder, graphite, talc, titanium dioxide, and zircon, which materials are suspended in an organic solvent, such as isopropyl alcohol. These solid particles of release materials have a particle size of less than about 100 microns and an average particle size of less than about 40 microns. The percentage of these release material particles in the suspension ranges between about 5% and 60% by weight of the whole suspension for the heavier particles like titanium dioxide and zircon and only up to about 40% by weight of the lighter particles like anhydrous aluminum, graphite and talc.

In order to bind together the particles of the release material in the final coating, there is added to the second liquid suspension a resinous binder, such as a dark brittle high melting point alaphatic hydrocarbon insoluble thermoplastic resin or a phenolic resin, in an amount between about 0.2 and 10% and preferably between about 1% and 5% by weight of the liquid suspension.

In addition to the release materials and binder in this outer or top coating, there are also added less than about 15% by weight of the liquid suspension of at least two different compounds or additives from the group of additives consisting of (1) a suspension agent, (2) a dispersant, and (3) an anti-settling agent. The suspension agent may be similar to that employed in the first coating, namely a clay derivative composition or aluminum silicate compound, including clays, "Bentone", bentonite, kaolin, and the like. The amount of the suspension agent is less than about 10% by weight of the liquid suspension. The dispersant may be a phosphate, polycarbonate or sulfonate and added in an amount up to about 4% by weight of the liquid suspension. The anti-settling agent may be a methoxy propylamine and may be added up to an amount of about 3% by weight of the liquid suspension.

In the second or release coating, the non-aqueous or organic liquid is generally a major portion of the suspension composition, namely ranging between about 30 and 90% by weight of the liquid suspension including the solids therein.

When the second and soft coating is dried on the first coating on the core, the thickness of this second coating is usually less than that of the first coating and ranges between about 15 and 2000 microns and preferably between about 25 and 750 microns (0.001 and 0.030 inches) and more preferably between about 50 and 200 microns (0.002 and 0.008 inches). Since this top coating is softer than the first coating, it can be compressed by the pressure of the hot metal flowing against it, and accordingly can be made thicker than the hard base coating, if desired.

IV. Specific Examples

The following Table I is of six different compositions of the aqueous first, base, hard refractory coating that have been used on sand cores of the specific composition mentioned above, which coatings have produced successful cores and die castings with undercut portions:

TABLE I

| FIRST COATING SUSPENSION COMPOSITION | | | | | | |
|---|---|---|---|---|---|---|
| Ingredients in Percentage by Weight | Example 1 | Example 2 | Example 3 | Example 4 | Example 5 | Example 6 |
| Refractories 40–85% | | | | | | |
| Fused Silica 40–80% | 50.67 | 73.00 | 69.30 | 60.17 | 60.57 | 65.34 |
| Alumina 0–50% | | | | 15.11 | 14.76 | |
| Zirconia 0–50% | 25.5 | | | | | |
| Kaolin 0–15% | | | | | | 10.9 |
| Binder 1–15% | | | | | | |
| Colloidal Silica | 5.63 | 8.09 | 7.70 | 9.01 | 9.03 | 9.16 |
| Additives .1–1.5% | | | | | | |
| (1) Suspension Agent 0–1% | | | | | | |
| Amine-treated Bentonite ("Bentone") | 0.20 | 0.20 | 0.50 | | 0.20 | |
| (2) Dispersant 0–1.5% | | | | | | |
| Alkali Polyacrylate | | | | 0.10 | 0.20 | 0.20 |
| Alkali Phosphate | 0.30 | | 0.10 | | | |
| (3) Anti-skinning Agent 0–.1% | | | | | | |
| More than 8 carbon atom alcohol | | 0.05 | | 0.01 | | |
| (4) Wetting Agent 0–.5% | | | | | | |
| Tertiary Acetylene Diol | | 0.05 | | | | |
| Water 12–30% | 17.7 | 18.60 | 22.40 | 15.60 | 15.24 | 14.40 |

The second, top, soft release coatings were produced according to the five examples in the following Table II and were applied to the first coatings in the Examples 1 through 6 in Table I above, and successful results were obtained therefor both in the production of the coated cores and in the final castings with smooth undercut regions.

TABLE II

| SECOND COATING SUSPENSION COMPOSITION | | | | | |
|---|---|---|---|---|---|
| Ingredients in Percentages by Weight | Example 1 | Example 2 | Example 3 | Example 4 | Example 5 |
| Release Materials 5–60% | | | | | |
| Anhydrous Powdered Aluminum 0–30% | | 12.2 | | 12.7 | |
| Graphite 0–40% | 28.5 | | 28.5 | | |
| Talc 0–40% | | 13.1 | | | |
| Titanium Dioxide 0–40% | | | | | 25.0 |
| Zircon 0–60% | | | | 9.1 | |
| Binder .2–10% | | | | | |
| Phenolic Resin 0–5% | 1.5 | | | | |
| Thermoplastic Resin 0–5% | | 1.7 | 2.0 | 1.8 | 1.5 |
| Additives .05–15% | | | | | |
| (1) Suspension Agent 1–10% | | | | | |
| "Bentone" | 4.3 | 2.6 | 4.3 | 2.7 | 4.2 |
| (2) Dispersant .05–4% | | | | | |
| Phosphate Ester/Sulfonate | 0.5 | | 0.5 | | 0.5 |
| Polycarbonate | | .1 | | .1 | |
| (3) Anti-settling Agent 0–3% | | | | | |
| Methoxy Propylamine | 1.2 | | 1.2 | | 1.2 |
| Solvent 30–90% | | | | | |
| Isopropyl Alcohol | 64.0 | 70.3 | 63.5 | 73.6 | 67.6 |

While there is described above the principles of this invention in connection with specific apparatus and compositions, it is to be clearly understood that this description is made only by way of example and not as a limitation to the scope of this invention.

I claim:

1. An expendable sand core having:
(a) good shake-out properties,
(b) good wash-out resistance,
(c) freedom from surface penetration,
(d) good shelf life, and
(e) high core strength, to withstand pressures in excess of 1000 psi and to form smooth undercut regions in a die casting, said core consisting essentially of:
(A) a base of sand having grains that touch each other with the spaces between the grains being at least partially filled with a resin binder;
(B) a first aqueous coating on said base consisting essentially of:
(1) at least about 40% by weight of said first coating of a refractory comprising fused silica having a particle size of less than about 100 microns and an average particle size of less than about 50 microns;
(2) at least 1% and less than about 15% by weight of the first aqueous coating of a binder; and
(3) at least 0.1 and less than about 1.5% by weight of said first aqueous coating of at least two different additives selected from the groups of additives consisting of: suspension agents, dispersants, wetting agents, and anti-skinning agents, and
(C) a second liquid release coating.

2. An expendable sand core according to claim 1 which can withstand pressures in excess of 5000 psi.

3. An expendable sand core according to claim 1 wherein the amount of the refractory in said first coating is at least about 65% by weight of the first coating.

4. An expendable sand core according to claim 1 wherein said fused silica in said first coating comprises at least about 40% by weight of solids in said first coating.

5. An expendable sand core according to claim 1 wherein said binder comprises colloidal silica.

6. An expendable sand core according to claim 1 wherein said suspension agent is an aluminum silicate compound.

7. An expendable sand core according to claim 1 wherein said dispersant is a deflocculent.

8. An expendable sand core according to claim 1 wherein the thickness of said first coating on said sand core is between about 25 and 2000 microns.

9. An expendable sand core according to claim 8 wherein the thickness of said first coating on said sand core is between about 100 and 750 microns.

10. An expendable sand core according to claim 9 wherein the thickness of said first coating on said sand core is preferably between about 150 and 500 microns.

11. An expendable sand core according to claim 1 wherein said second liquid release coating consists essentially of:
(1) release particles having a particle size less than 100 microns and an average particle size less than about 40 microns selected from the group consisting of anhydrous powdered aluminum, graphite, talc, titanium dioxide and zircon;
(2) between about 0.2 and 10% by weight of said second liquid coating of a resinous binder;
(3) between about 0.05 and 15% by weight of said second liquid coating of at least two additives selected from the groups of additives consisting of a suspension agent, an anti-settling agent, and a dispersant; and
(4) at least about 30% by weight of said second liquid coating of an organic solvent.

12. An expendable sand core according to claim 11 wherein said solid release material comprises between 5 and 60% by weight of said second liquid coating.

13. An expendable sand core according to claim 11 wherein said release particles in said second liquid coating comprise anhydrous powdered aluminum particles.

14. An expendable sand core according to claim 11 wherein the amount of resinous binder in said second liquid coating is between about 1 and 5% by weight of said second liquid coating.

15. An expendable sand core according to claim 11 wherein said binder in said second coating comprises a thermoplastic resin.

16. An expendable sand core according to claim 11 wherein said suspension agent in said second coating comprises an aluminum silicate compound.

17. An expendable sand core according to claim 11 wherein said organic solvent is isopropyl alcohol.

18. An expendable sand core according to claim 11 wherein said liquid of said second liquid coating comprises between about 30% and 90% by weight of said second liquid coating.

19. An expendable sand core according to claim 12 wherein the thickness of the second coating on said first coating on said core is between about 15 and 2000 microns.

20. An expendable sand core according to claim 19 wherein the thickness of said second coating on said first coating on said core is between about 25 and 750 microns.

21. An expendable sand core according to claim 20 wherein said second coating on said first coating has a thickness between about 50 and 200 microns.

22. An expendable sand core having:
(a) good shake-out properties,
(b) good wash-out resistance,
(c) freedom from surface penetration,
(d) good shelf life, and
(e) high core strength, to withstand pressures in excess of 1000 psi and to form smooth undercut regions in a die casting, said core consisting essentially of:
(A) a base of sand having grains that touch each other with the spaces between the grains being at least partially filled with a resin binder;
(B) a first aqueous refractory coating on said base; and
(C) a second liquid release coating on said first refractory coating consisting essentially of:
(1) solid release particles having a particle size less than 100 microns and an average particle size of less than about 40 microns selected from the group consisting of: anhydrous powdered aluminum, graphite, talc, titanium dioxide and zircon;
(2) between about 0.2 and 10% by weight of said second liquid coating of a resinous binder;
(3) between about 0.05 and 15% by weight of said second liquid coating of at least two different additives selected from the groups of additives consisting of a suspension agent, an anti-settling agent and a dispersant; and (4) at least about 30% by weight of an organic solvent.

23. An expendable sand core according to claim 22 which can withstand pressures in excess of 5000 psi.

24. An expendable sand core according to claim 22 wherein said release material in said second liquid coating comprises between about 5 and 60% by weight of said second liquid coating.

25. An expendable sand core according to claim 22 wherein said release particles in said second liquid coating comprise anhydrous powdered aluminum particles.

26. An expendable sand core according to claim 22 wherein the amount of resinous binder in said second liquid coating is between about 1 and 5% by weight of said second liquid coating.

27. An expendable sand core according to claim 22 wherein said binder in said second liquid coating comprising a thermoplastic resin.

28. An expendable sand core according to claim 22 wherein said suspension agent comprises an aluminum silicate compound.

29. An expendable sand core according to claim 22 wherein said additives comprise less than about 15% by weight of said second liquid coating.

30. An expendable sand core according to claim 22 wherein said organic solvent is isopropyl alcohol.

31. An expendable sand core according to claim 22 wherein said liquid of said second liquid coating comprises between about 30% and 90% by weight of said second liquid coating.

32. An expendable sand core according to claim 22 wherein the thickness of the second coating on said first coating on said core is between about 15 and 2000 microns.

33. An expendable sand core according to claim 32 wherein the thickness of said second coating on said first coating on said core is between about 25 and 750 microns.

34. An expendable sand core according to claim 33 wherein said second coating on said first coating has a thickness between about 50 and 200 microns.

35. An expendable sand core having:

(a) good shake-out properties, (b) good wash-out resistance, (c) freedom from surface penetration, (d) good shelf life, and (e) high core strength, to withstand pressures in excess of 1000 psi and to form smooth undercut regions in the die casting, said core consisting essentially of:

(A) a base of sand having grains that touch each other with the spaces between the grains being at least partially filled with a resin binder;

(B) a first aqueous coating on said base consisting essentially of:

(1) at least about 40% by weight of said first coating of a refractory material comprising fused silica having a particle size of less than about 100 microns and an average particle size of less than about 50 microns;

(2) at least 1% and less than about 15% by weight of the first aqueous coating of a binder;

(3) at least 0.1% and less than about 1.5% by weight of said first aqueous coating of at least two additives selected from the groups of additives consisting of: a suspension agent, a dispersant, a wetting agent, and an anti-skinning agent; and (C) a second liquid release coating on said first refractory coating consisting essentially of:

(1) solid release particles having a particle size less than 100 microns and an average particle size less than about 40 microns selected from the group consisting of: anhydrous powdered aluminum, graphite, talc, titanium dioxide and zircon;

(2) between about 0.2 and 10% by weight of said second liquid coating of a resinous binder, (3) between about 0.05 and 15% by weight of said release coating of at least two additives selected from the groups of additives consisting of a suspension agent, an anti-settling agent, and a dispersant, and (4) at least about 30% by weight of an organic solvent.

36. An expendable sand core according to claim 35 which can withstand pressures in excess of 5000 psi.

37. An expendable sand core according to claim 35 wherein the amount of the refractory in said first coating is at least about 65% by weight of the first coating.

38. An expendable sand core according to claim 35 wherein the fused silica in the first coating comprises at least about 40% by weight of solids in the first coating.

39. An expendable sand core according to claim 35 wherein said binder comprises colloidal silica.

40. An expendable sand core according to claim 35 wherein said suspension agent is an aluminum silicate compound.

41. An expendable sand core according to claim 35 wherein said dispersant is a deflocculant.

42. An expendable sand core according to claim 35 wherein the thickness of said first coating on said sand core is between about 25 and 2000 microns.

43. An expendable sand core according to claim 42 wherein the thickness of said coating on said core is between about 100 and 750 microns.

44. An expendable sand core according to claim 43 wherein said thickness of said coating is between about 150 and 500 microns.

45. An expendable sand core according to claim 35 wherein said release material comprises between about 5% and 60% by weight of said second liquid coating.

46. An expendable sand core according to claim 35 wherein said release particles in said second liquid coating comprises anhydrous powdered aluminum particles.

47. An expendable sand core according to claim 35 wherein the amount of resinous binder in said second liquid coating is between about 1 and 5% by weight of said second liquid coating.

48. An expendable sand core according to claim 23 wherein said binder in said second coating comprises a thermoplastic resin.

49. An expendable sand core according to claim 35 wherein said suspension agent in said second coating comprises an aluminum silicate compound.

50. An expendable sand core according to claim 35 wherein said additive in said second coating comprises less than about 15% by weight of the second liquid coating.

51. An expendable sand core according to claim 35 wherein said organic solvent is an isopropyl alcohol.

52. An expendable sand core according to claim 35 wherein said liquid in said second liquid coating comprises between about 30% and 90% by weight of said second liquid coating.

53. An expendable sand core according to claim 35 wherein the thickness of the second coating on said first coating on said core is between about 15 and 2000 microns.

54. An expendable sand core according to claim 53 wherein the thickness of said second coating on said first coating on said core is between about 25 and 750 microns.

55. An expendable sand core according to claim 54 wherein said second coating on said first coating has a thickness between about 50 and 200 microns.

* * * * *